US006209468B1

(12) United States Patent
Marcangelo et al.

(10) Patent No.: US 6,209,468 B1
(45) Date of Patent: Apr. 3, 2001

(54) METHOD AND APPARATUS FOR SEWING HANDLES ON A STRIP OF MATERIAL

(75) Inventors: Steve Marcangelo, Derry, NH (US); Michael R. Porter, Topsfield, MA (US)

(73) Assignee: Porter International

( * ) Notice: Subject to any disclaimer, the term of this patent is extended or adjusted under 35 U.S.C. 154(b) by 0 days.

(21) Appl. No.: 09/350,957

(22) Filed: Jul. 9, 1999

(51) Int. Cl.[7] ..... D05B 11/00; D05B 35/06

(52) U.S. Cl. ..... 112/475.06; 112/475.07; 112/470.05; 112/470.33; 112/2.1

(58) Field of Search ..... 112/2.1, 470.33, 112/470.34, 470.05, 470.06, 475.02, 475.05, 475.06, 475.07, 475.08, 104, 113, 130, 307

(56) References Cited

U.S. PATENT DOCUMENTS 5,881,656 * 3/1999 Grant ..... 112/2.1
5,983,814 * 11/1999 Block ..... 112/470.33 X

* cited by examiner

*Primary Examiner*—Peter Nerbun
(74) *Attorney, Agent, or Firm*—Wolf, Greenfield & Sacks, P.C.

(57) ABSTRACT

A method and apparatus are provided for sewing handles lengthwise on a strip of mattress border material or other elongated strip of material. A fold is formed and aligned on a leading end of handle stock and is advanced to a sewing head where the fold is sewn to the strip of material. The handle stock is then cut at a point to leave the proper length of handle stock to form the handle and a fold is formed in the trailing end of the handle, aligned and positioned at the sewing head where it is sewn to the strip material to complete the handle. All of the above are performed automatically under programmable control.

20 Claims, 18 Drawing Sheets

METHOD AND APPARATUS FOR SEWING HANDLES ON A STRIP OF MATERIAL

FIELD OF THE INVENTION

This invention relates to sewing machines and more particularly to a method and apparatus for sewing handles lengthwise on a strip of material, which strip of material is, for preferred embodiments, a border strip of a mattress.

BACKGROUND OF THE INVENTION

While handles may be sewn on a strip of material in a variety of applications, perhaps the most common application for such sewing is in sewing handles on the border strip of a mattress, inner spring or the like. Since such handles are used to lift heavy mattresses, they must be strong, one way of achieving such strength being to fold over the ends of the stock used for forming each handle to form a double thickness at the ends where sewing is performed. However, it is also important that the handles have an attractive appearance. The folds, in addition to providing to strength, also give a cleaner look to the ends of the handle. However, for good aesthetic appearance, the folds on both ends of each handle should be of substantially the same length, both layers of each fold should be perfectly aligned and the handle should lie substantially flat against the mattress when not in use.

Heretofore, such aesthetically pleasing handles have been achieved only by using semiautomated techniques for sewing the handles, it otherwise being difficult to compensate for skewing of fold ends, stretching of for example the border material which may prevent the handle from laying flat and various factors influencing the length of the folds. However, any machine requiring a skilled operator is more expensive to operate than a fully automated machine and semi-automated machines are also significantly slower. A fully automated machine operating under computer control can also provide greater flexibility in the jobs that can be performed and the way the jobs are performed, for example permitting borders for different sized mattresses to be handled without expensive hand readjustments of the machine.

In view of the above, it would be preferable if a machine and a method for the operation thereof could be developed which would permit the filly automated sewing of handles on mattress border stock or other suitable strips of material at relatively high speed while still achieving quality, aesthetically pleasing handles.

SUMMARY OF THE INVENTION

In accordance with the above, this invention provides a method and apparatus for automatically sewing handles lengthwise on an elongated strip of material, for example mattress border material, which includes the forming of a fold on a leading edge of a handle stock, the moving of the fold to a sewing head where the fold is sewn to the border or other strip of material, the cutting of a sufficient length of handle stock to form the handle and the forming of a fold on a trailing end of the handle at the sewing head where it is sewn to the strip of material, thereby completing the handle. The forming of each handle fold preferably includes method/apparatus facilitating the alignment of the fold.

More specifically, the apparatus includes a first handle stock feeding assembly, a second stationary sewing head assembly, a programmably controlled drive for effecting relative movement between the first and second assemblies toward and away from each other and a second programmably controlled drive for feeding the strip of material to and through the sewing head of a sewing head assembly. The first assembly includes an extending guide plate coacting with first components on the second or sewing head assembly as the first drive moves the assemblies toward each other to form a fold in the leading edge of the handle stock and deliver the fold to the sewing head where the fold is sewn to the strip of material. A cutter is also provided on the first assembly for cutting a sufficient length of the handle stock to form the handle. Finally, the extending guide plate coacts with second components on the second assembly to form a fold at the sewing head on a trailing end of the handle, the fold being sewn to the strip of material to complete the handle.

In operation, a length of handle stock sufficient to form the first fold extends beyond the end of the guide plate when the guide plate reaches the first components, the first components including a folding bar and a drive moving the bar down over the leading edge of the guide plate to fold the length of handle stock down, the guide plate passing over the bar as the first assembly continues to move toward the second assembly. This results in the bar pressing the length of handle stock against the bottom of the guide plate to form the fold. For preferred embodiments, the folding bar includes a flexible extension or drum thereover which coacts with edge projections or fingers on the guide plate to assure proper alignment for the folded over length of handle stock. The flexible drum preferably also maintains a desired tension on the handle stock. For a preferred embodiment, the sewing head also includes staking needles and a drive mechanism which moves the needles into engagement with each fold when the fold is positioned at the sewing head, removes the staking needles when the fold is clamped by the sewing head and tilts the staking needles out of the way once they have been retracted. An end detector is also provided for the handle, the guide plate coacting with the second components to form the fold on the trailing end of the handle in response to a selected output from the detector.

The second components preferably include a rear folding bar and a folding blade, the bar and blade normally being retracted to an inoperative position, and a drive being provided for moving the bar and blade to an operative position at a selected time after the fold at the leading end of the handle has been sewn to the strip of material. The second components also include a drive which moves the folding bar down past a trailing edge of the blade when only a length of the trailing end of the handle stock sufficient to form a fold extends beyond the trailing edge of the blade, the bar folding the trailing end of the handle over the trailing edge of the blade. Finally, a mechanism is provided for folding the trailing end of the handle under the blade to form the trailing end fold on the handle. For a preferred embodiment, the mechanism for folding the trailing end includes the programmably controlled drive moving the guide plate under the blade. The folding bar and/or the foot preferably include components for facilitating alignment of the fold. Alternatively, the second folding bar and the blade may be moved relative to each other so that the bar passes under the blade to fold the trailing end of the handle thereunder.

The method for sewing the handles preferably includes the steps of: (a) feeding the strip of material to and through the sewing head, such feeding being programmably controlled; (b) feeding a leading end of handle stock to extend beyond the end of the guide plate on the feed assembly by a length sufficient to form a handle fold; (c) moving a folding bar down past the tip of the guide plate to fold the extending handle stock down over the guide plate; (d) moving the feed assembly toward the sewing head with the guide plate over the fold bar to form a handle fold, this step continuing until the fold is at the sewing head; (e) using the sewing head to sew the fold on the handle stock to the strip of material; (f) cutting the handle stock at a point so as to provide sufficient handle stock to form the handle; (g) continuing step a, the handle now sewn to the strip of material moving therewith; (h) moving a second folding bar and a folding blade into a position adjacent the sewing head with the bar above the handle and adjacent the trailing edge of the blade and with the blade below the handle; (i) detecting when the cut trailing end of the handle reaches a selected position, for example, when a length of this end sufficient to form a fold extends beyond the trailing edge of the folding blade; (j) moving the second folding bar down past the trailing edge of the blade to fold the extending length of material down; (k) moving the feed assembly toward the sewing head with the guide plate under the blade to form a fold on the trailing end of the handle; and (l) sewing the fold to the strip of material to complete the handle. For preferred embodiments, the following steps are performed after step (d) and after step (k): (m) moving staking needles down into the fold; (n) moving the feed assembly, including the guide plate, away from the sewing head, (o) clamping the fold, and (p) moving the staking needles up and out of the fold and tilting the staking needles out of the way. Step (c) preferably includes utilizing a resilient drum on the folding bar acting in conjunction with edge projections/fingers on the guide plate to align the forward fold, and step (j) preferably includes utilizing spaced collars on the folding bar to align the rear fold.

The foregoing other objects, features and advantages of the invention will be apparent from the following more particular description of a preferred embodiment of the invention as illustrated in the accompanying drawings, common reference numerals being utilized to refer to common elements in the various figures.

IN THE DRAWINGS

DETAILED DESCRIPTION

Figure 2:
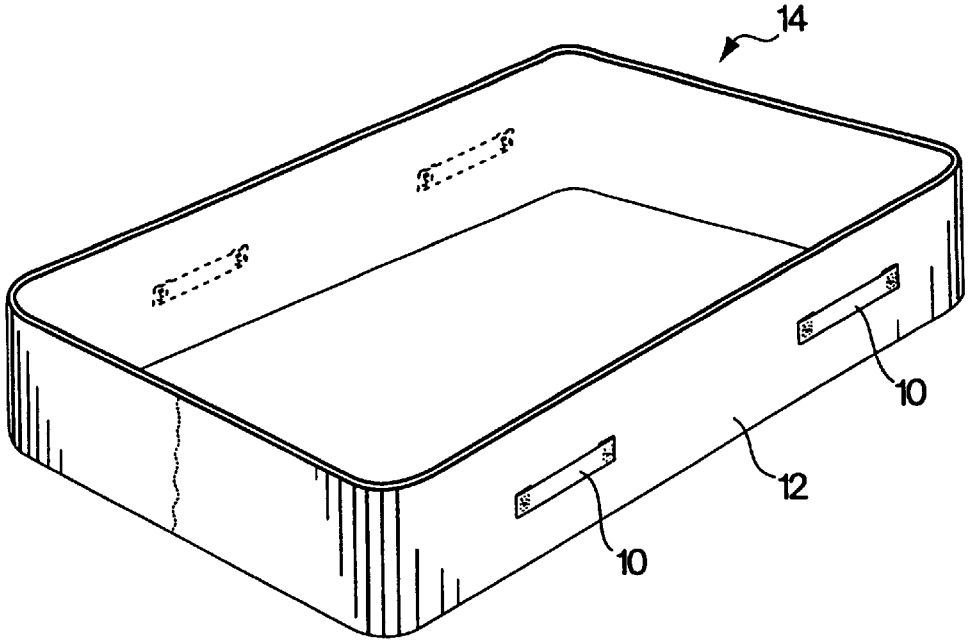
FIG. 2 is a perspective view of a mattress having handles sewn thereon in accordance with the teachings of this invention.
Figure 3:
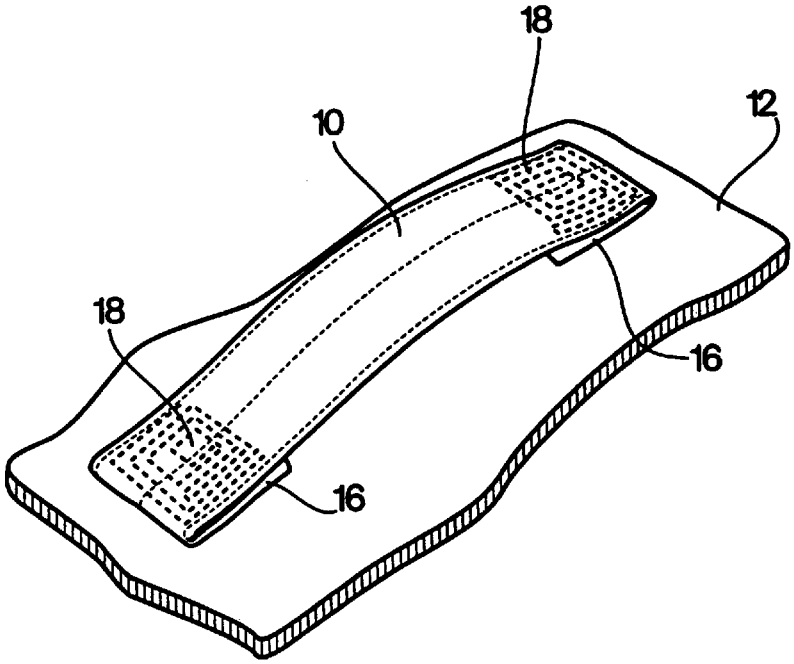
FIG. 3 is an enlarged perspective view of a single hand of FIG. 2.

While the invention may be utilized to sew handles on a strip of material for a variety of applications, for the preferred embodiment to be described hereinafter it will be assumed, as shown in FIGS. 2 and 3, that handles 10 are being sewn on a side binding strip 12 of a mattress or inner spring 14. Both to achieve a more pleasing aesthetic appearance and for enhanced strength, a fold 16, which may be best seen in FIG. 3, is provided on each end of each handle, with stitching 18 being performed through each fold 16. The pattern utilized for stitching 18 may vary with application, and, as will be discussed later, the sewing machine of this invention may be programmed to provide a variety of patterns for stitching 18. In order to achieve a pleasing aesthetic appearance for handles 10, the bottom of each fold 16 must align perfectly with the top of the fold, the length of each fold 16 for each handle 10, and preferably for all the folds 16 of the handles for a given mattress, should be of substantially identical length and all of the handles 10 should lie flat against binding 12 when not in use. Each handle 10 should of course also be perfectly aligned with the top and bottom edges of binding 12 rather than at an angle thereto. In accordance with the teachings of this invention, all of these objectives are achieved while providing a fully automated machine capable of sewing handles at relatively high speed, and, by requiring minimum operator intervention, at relatively low operating cost.

Figure 1:
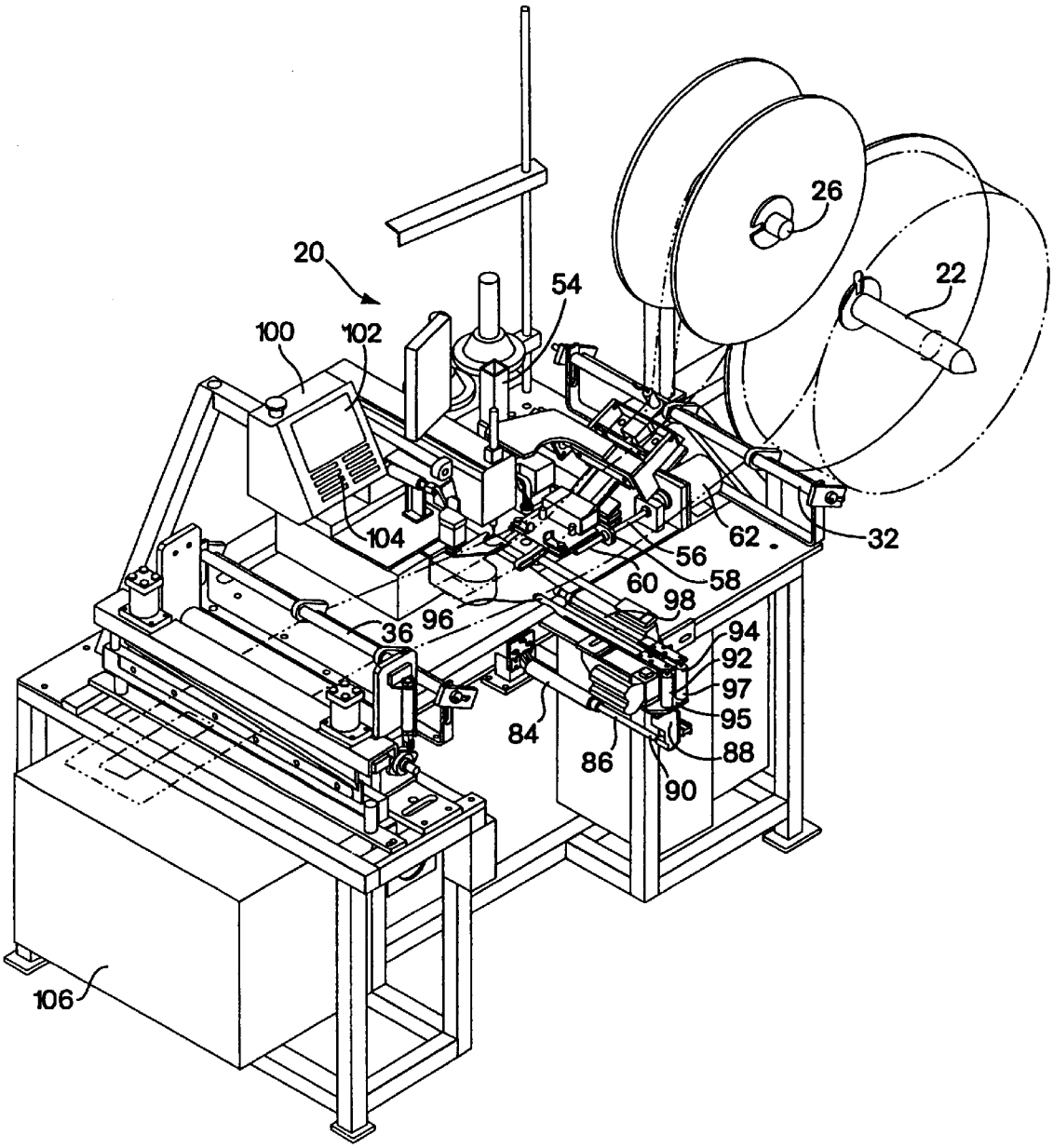
FIG. 1 is a perspective view of a sewing machine suitable for practicing the teachings of this invention.
Figure 4:
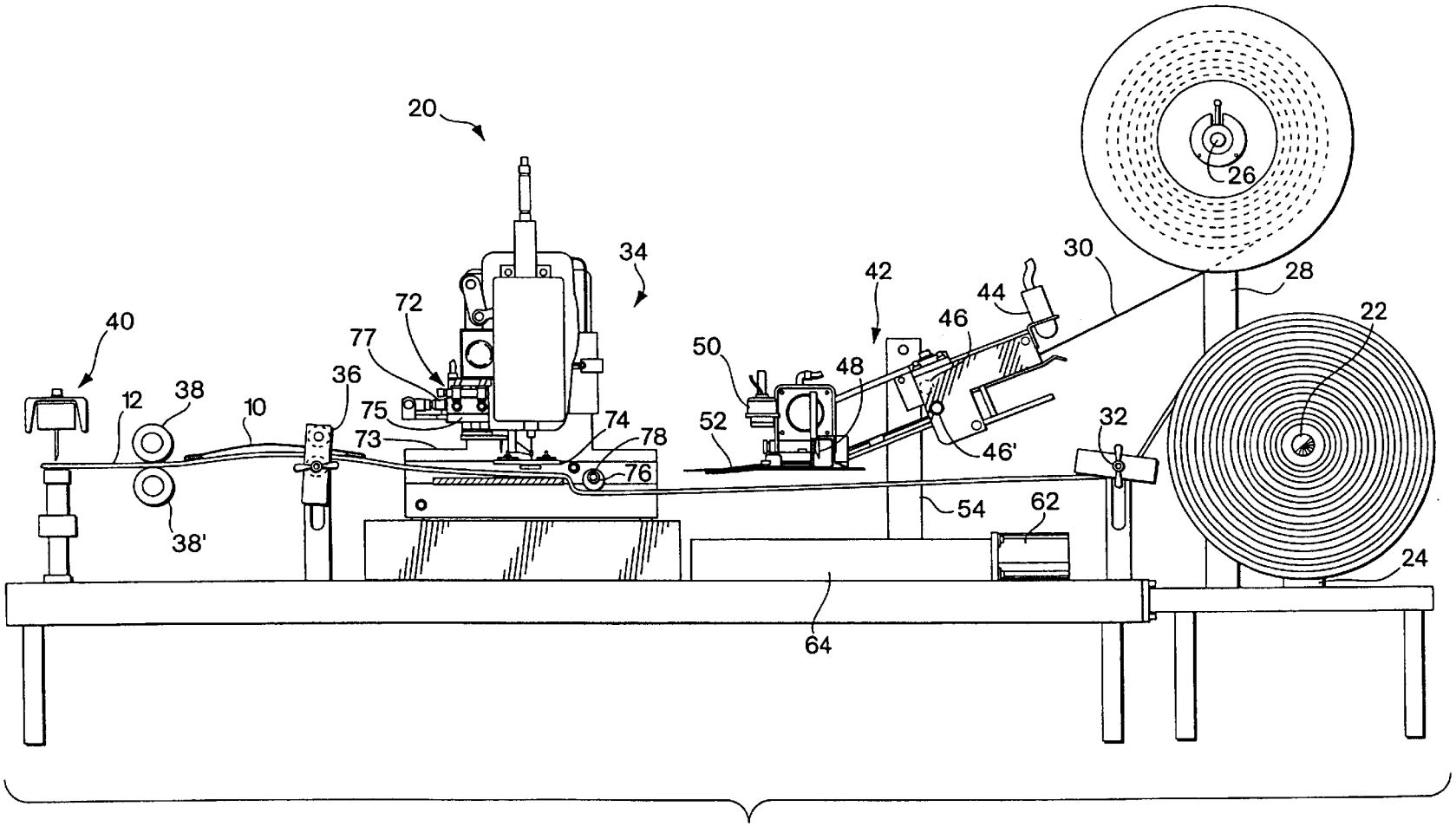
FIG. 4 is a simplified side view of the sewing machine shown in FIG. 1.

FIGS. 1 and 4 are respectively a prospective view of a machine 20 suitable for use in practicing the teachings of this invention and a simplified side view of the machine 20 in operation. Referring to these figures, it is seen that a roll of binding stock 12 is mounted on a spindle 22 supported on an arm 24, and a roll of handle stock 30 is mounted on a second spindle 26 supported on arm 28. Binding stock 12 passes through a standard tensioning mechanism 32, a sewing head assembly 34, a take away tensioning mechanism 36 and a pair of feed rollers 38, 38', at least one of which is driven, for example roller 38', to a pneumatically operated cutter 40. A take away mechanism can also be provided beyond cutter 40 or the cut binding with the handles sewn thereon may be dropped into a suitable receptacle.

Figure 6:
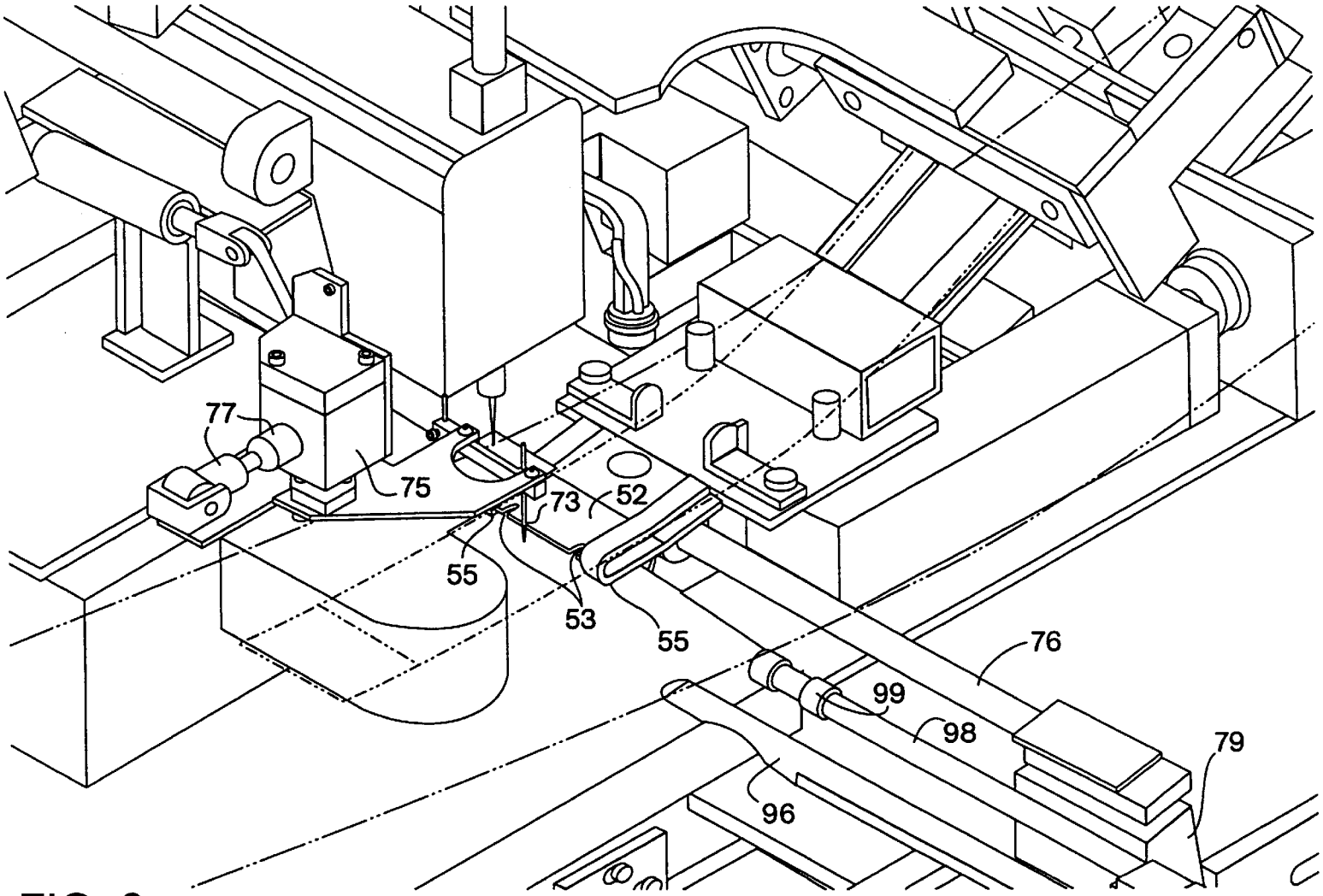
FIG. 6 is an enlarged perspective view of a guide plate and related components of the machine shown in FIG. 1.

Handle stock 30 passes to a handle stock feed assembly 42 which includes an optical end of stock detector 44, a pair of feed rollers 46 and 46', one of which, for example roller 46', is driven, a pneumatically driven cutter mechanism 48, a detector 50 at the leading edge of the assembly and a projecting guide plate 52 over which handle stock 30 passes. Guide plate 52 has a pair of spaced slots 53 (FIG. 6) formed in its leading edge and has a pair of projections or fingers 55 extending a short distance from each side of its leading edge, the spacing between fingers 55 being equal to or slightly greater than the width of handle stock 30. All of these components are mounted to a vertical arm 54 which is connected by a horizontal bar 56 (FIG. 1) to a nut 58 on a worm gear 60 driven by a motor 62. In FIG. 4, nut 54 and worm gear 60 are shown as covered by a cover 64. Motor 62 is a programmably controlled servo motor, the functioning of which will be discussed in greater detail in describing the operation of machine 20.

Figure 7:
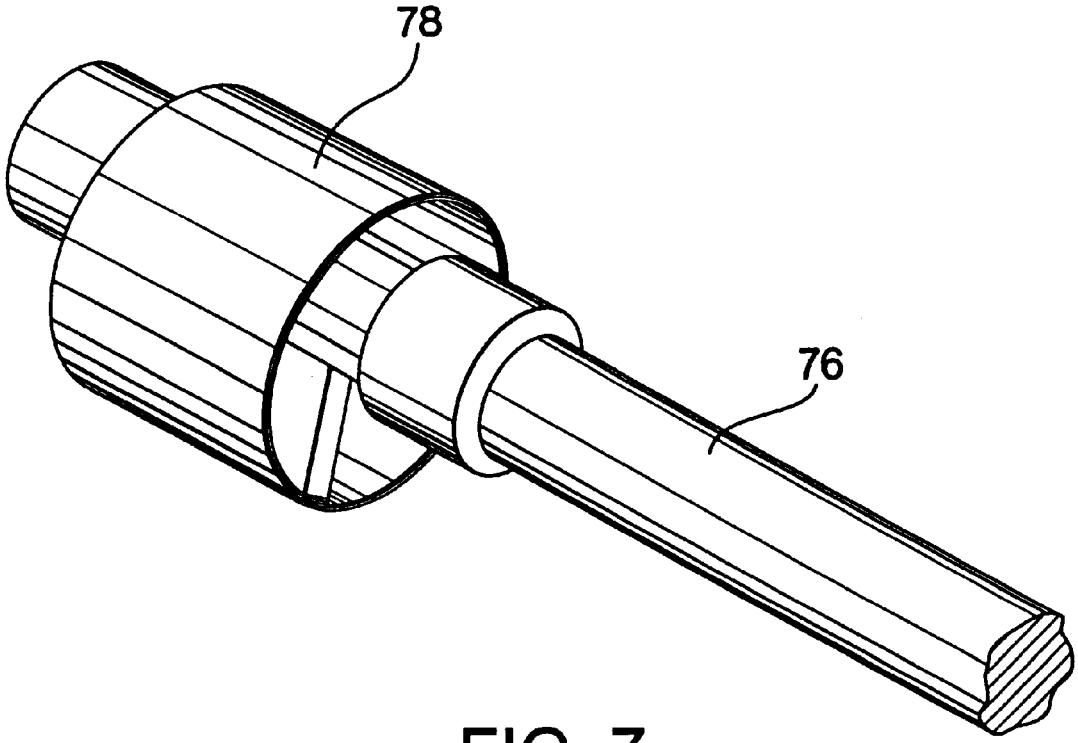
FIG. 7 is an enlarged perspective view of an alignment drum formed on a folding bar of the machine.

Sewing head assembly 34 includes sewing head 70, which may be of standard design; staking needle assembly 72, which includes staking needles 73, pneumatic actuators 75 for raising and lowering the staking needles, and pneumatic actuators 77 for tilting actuators 75 and needles 73 between an operative position and an out-of-the-way inoperative position; clamping plate 74; and a fold roller 76 having a slightly eccentric flexible extension or drum 78 mounted thereon. Drum 78 is preferably formed of a resilient drum spring covered with silicon rubber to provide the drum with tackiness. Drum 78, which may be best seen in FIG. 7, is eccentrically mounted at, for example, a 45° angle to equalize tension applied thereby. Bar 76 is raised and lowered by a pneumatic mechanism 79 (FIG. 5).

Figure 5:
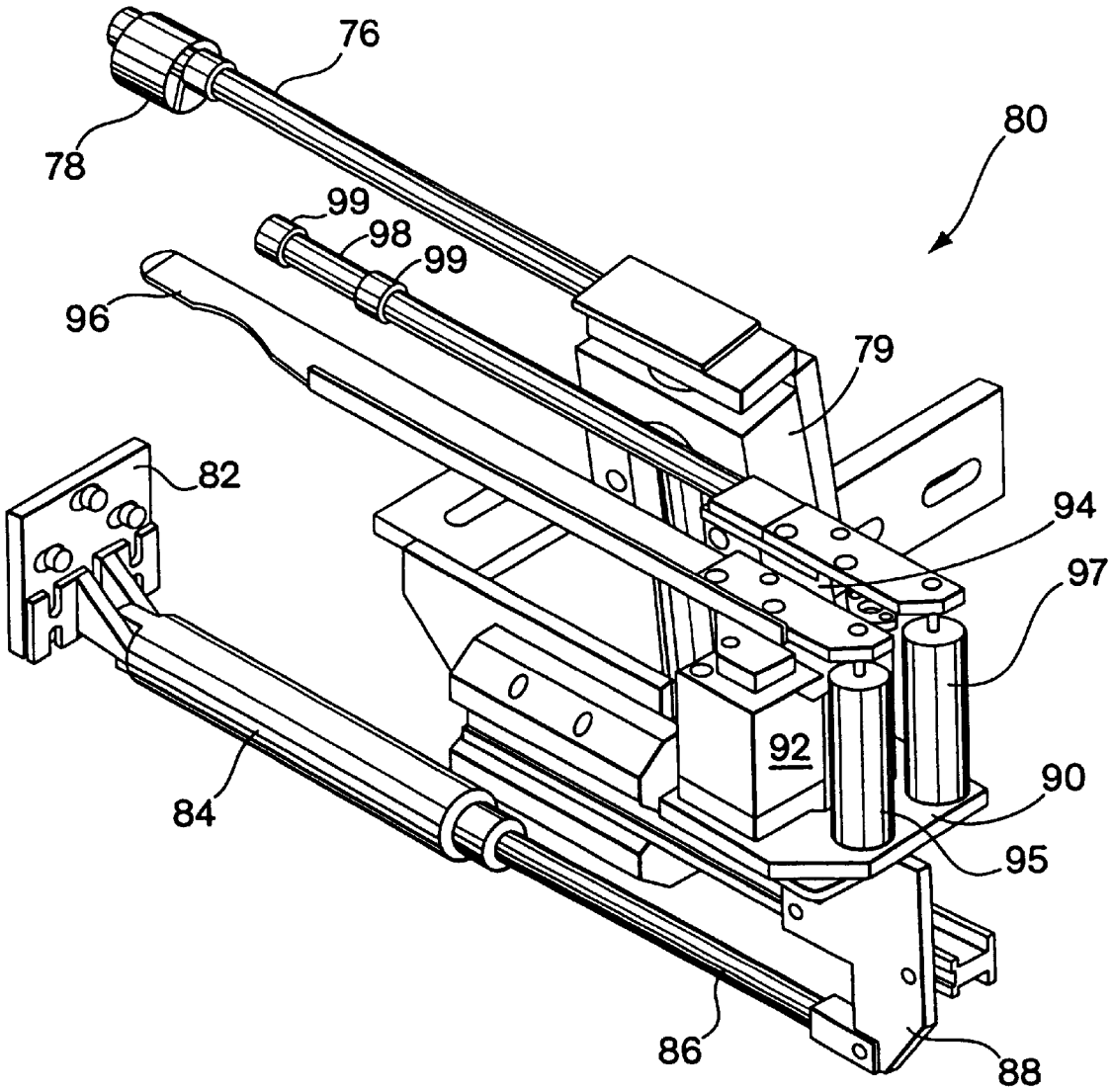
FIG. 5 is an enlarged perspective view of certain assemblies shown in FIG. 1.

The machine also includes an assembly 80 which is best seen in FIG. 5. Assembly 80 is mounted to the housing of sewing head assembly 34 by a bracket 82. A pneumatic cylinder 84 is attached to and extends from bracket 82. Arm 86 extending from pneumatic cylinder 84 is attached at its distal end through a linkage 88 to a plate 90 supporting a pair of pneumatic cylinders 92 and 94 and a pair of anti-rotation guide supports 95 and 97. A folding blade 96 is connected to the end of an arm extending from pneumatic cylinder 92 and a folding bar 98 is connected at the end of an arm extending from pneumatic cylinder 94. A pair of alignment collars 99 are either formed or mounted on bar 98. Both blade 96 and folding bar 98 extend back toward the sewing head, but are spaced away from the sewing head as shown in FIG. 1 when pneumatic cylinder 84 extends arm 86 as shown in FIGS. 1 and 5. However, when pneumatic cylinder 84 is activated to retract arm 86, blade 96 and bar 98 move adjacent to sewing head for purposes to be discussed later.

Finally, machine 20 includes a control panel or operator interface 100, including a display screen 102 and pressure sensitive input keys 104 which may be utilized by an operator to select various machine parameters, including the size of the mattress, the stitch pattern 18 for the handles and, where applicable, the thickness or type of material being used for stocks 12, 30 and other system variables. These inputs are fed to a control computer 106 which utilizes this information to control motor 62, the motors controlling the various feed rollers, including rollers 38 and 46, the various pneumatic cylinders, the sewing head, including the sewing pattern used by the head, and any other components of the system involved in the automatic operation thereof. As will be discussed below, except for the loading of control information on interface 100, the only operations on machine 20 which are manually performed are the mounting of rolls of stock 12 and 30 on spindles 22 and 26 respectively and the initial threading of this stock to the appropriate feed rollers.

In operation, a full roll of border stock 12 is mounted on spindle 22 and the leading edge of the border material is fed through tensioning device 32, under sewing head 70, through tensioning device 36 and feed rollers 38 and past cutter assembly 40. The operator may either carefully position the end of border material 12 so that the quantity of this material beyond sewing head 70 is known with reasonable precision, or preferably cutter 40 may be operated before sewing operations begin so that the location where the first handle is to be sewn may be precisely determined relative to the leading edge of border material stock 12. A roll of handle stock 30 is also mounted on spindle 26 and this stock is hand fed past feed rollers 46.

Figure 8:
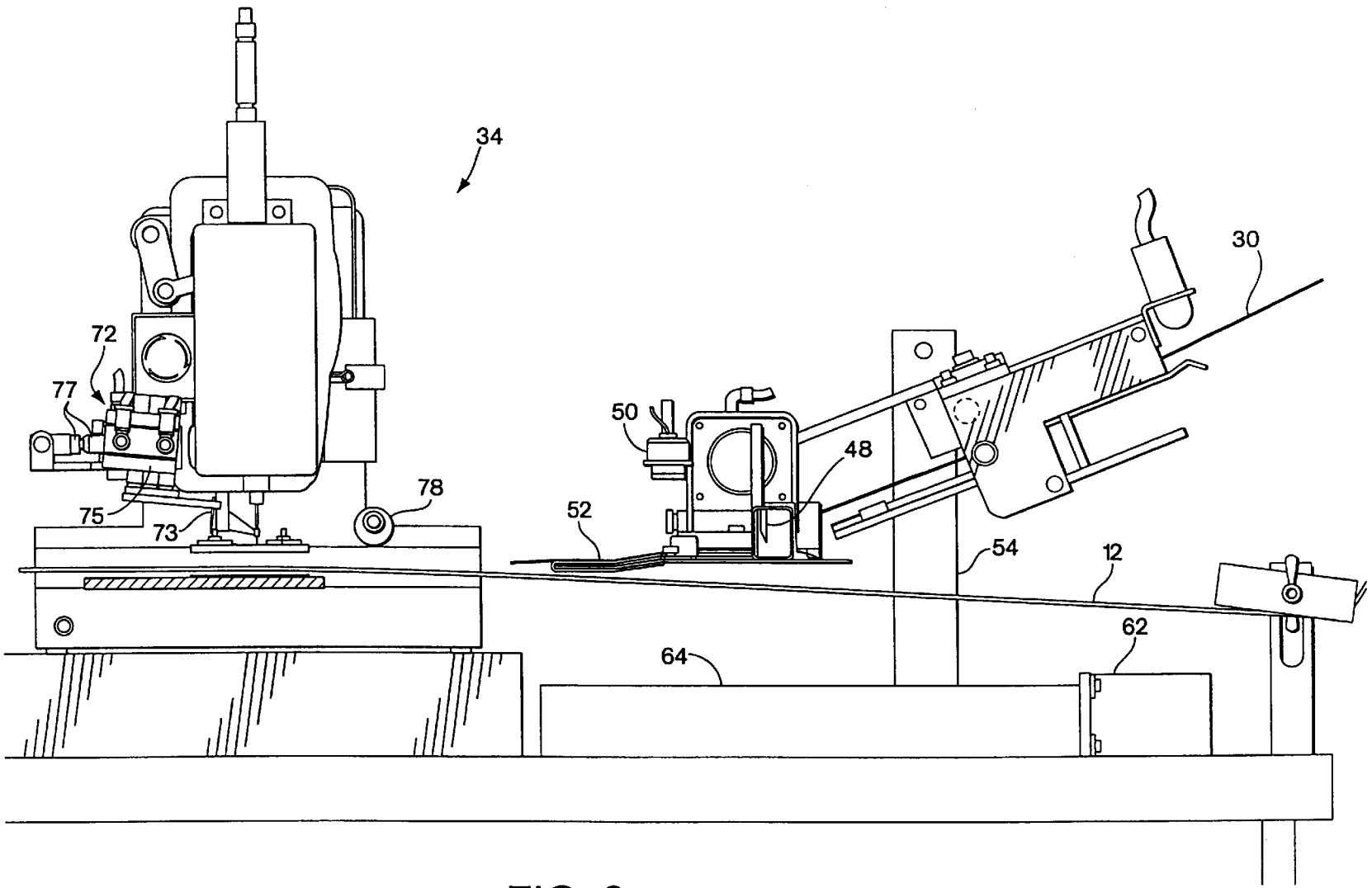
FIGS. 8–19 are simplified side views of a portion of the machine shown in FIG. 4 illustrating the relative positions of machine components at various stages in the operation of the machine.

At the beginning of a handle sewing operation, the components of machine 20 are positioned generally as shown in FIG. 8 with assembly 42 in a retracted position spaced to the left from sewing head assembly 34, fold bar 76 in a raised position, pneumatic cylinder 84 operated to extend arm 86, moving assembly 80, and in particular folding blade 96 and folding bar 98, away from the sewing head, and staking pins 73 raised and tilted out of the way. The final operation in getting to the state shown in View 1 is for drive rollers to be operated until detector 50 detects the leading edge of handle stock 30, and for the feed rollers to then continue to be operated for a precise additional number of revolutions to advance handle stock 30 so that a precise length 98 of the handle stock extends beyond the leading edge of guide plate 52, this precise amount being the amount required to form a handle fold 16.

Figure 9:
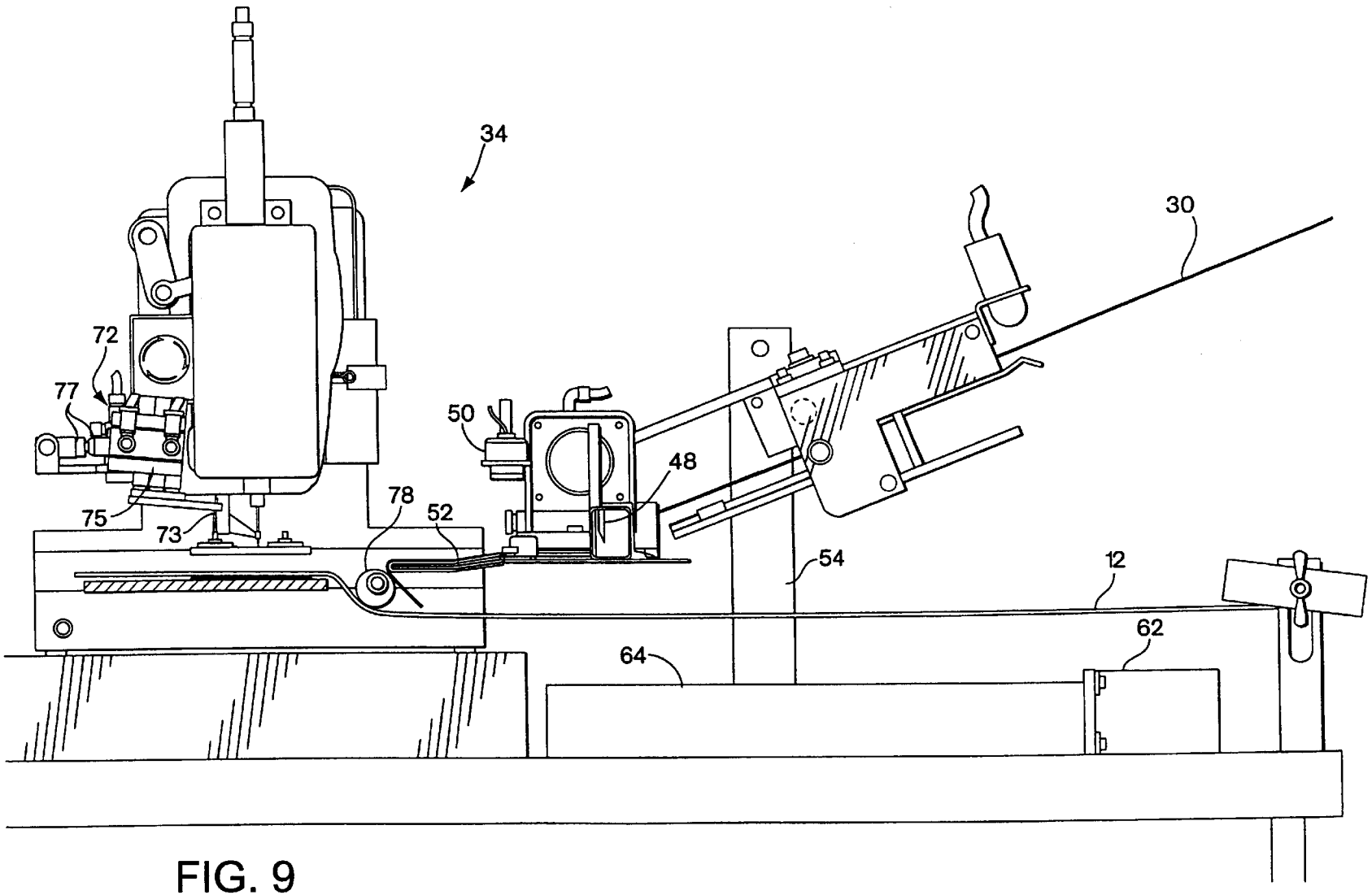

Referring now to FIG. 9, two things have happened. First, motor 62 has been operated to turn worm gear 60, moving feed assembly 42 to the left toward sewing head assembly 34 until fold bar 76 is adjacent the leading edge of guide plate 52. Pneumatic mechanism 79 is then operated to move fold bar 76 down past the leading edge of guide plate 52 to fold length of handle stock 98 extending beyond the end of guide plate 52 downward. As may be best seen in FIG. 6, guide fingers 55 extend slightly beyond the ends of guide plate 52, the spacing between fingers 55 being substantially equal to the width of handle stock 30. The width of drum 78 on fold bar 76 is also substantially equal to the width of the handle stock and is positioned so that the drum passes between fingers 55 as fold bar 76 passes adjacent the tip of guide plate 52. Drum 78 and extending fingers 55 thus coat to force the handle stock being folded by bar 76 between fingers 55 so as to assure alignment of the two sides of the fold 16 being formed, and thus to assure proper alignment of the handle. Bar 76 stops just under guide plate 52 with drum spring 78 exerting pressure on the underside of the guide plate, and thus on the fold of handle stock pinched between guide plate 52 and the drum spring. This maintains tension on the end of the handle stock 30 and also starts to fold material extension 98 under guide plate 52 as shown in View 2.

Figure 10:
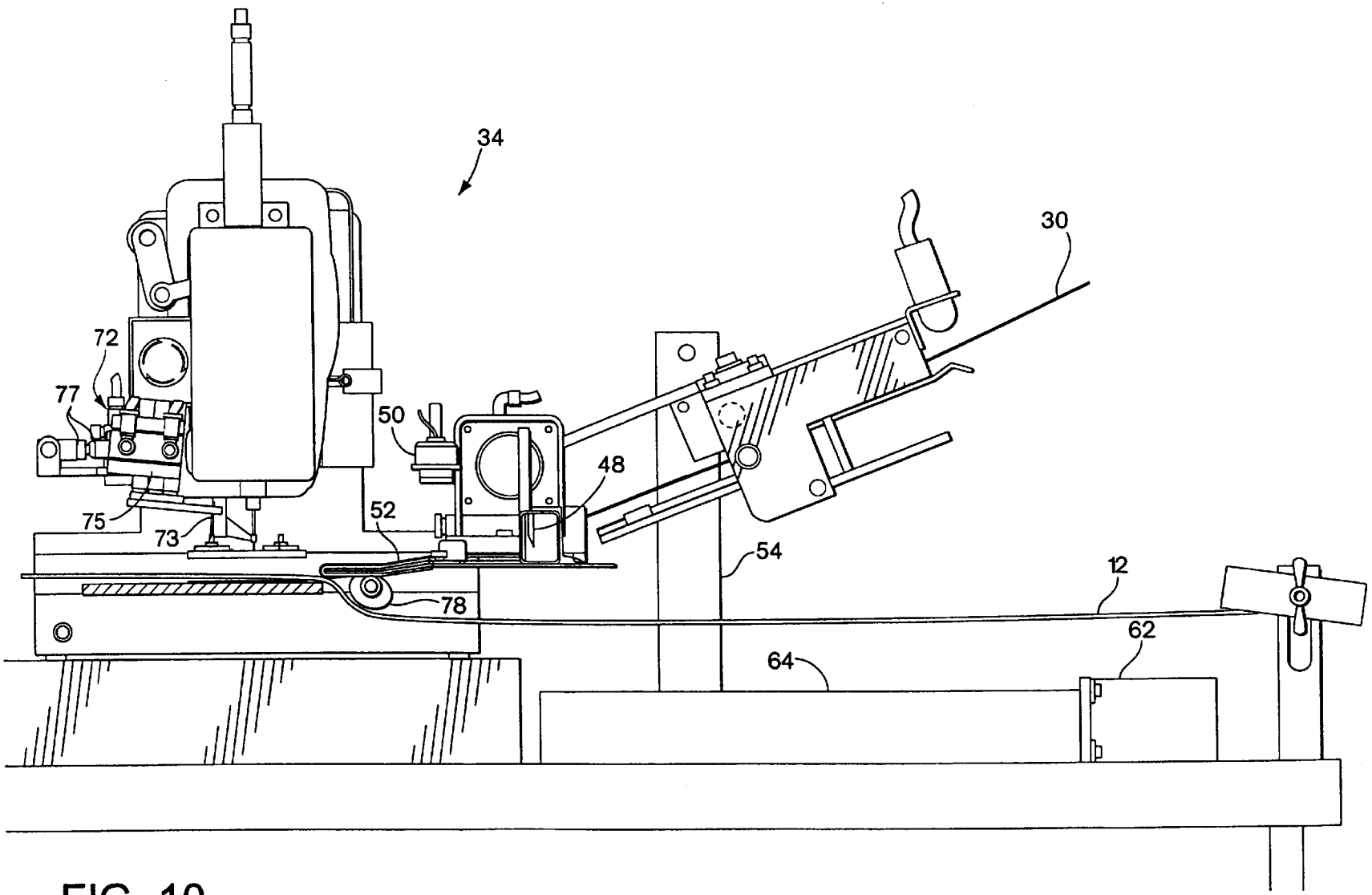

Referring to FIG. 10, feed assembly 42 continues to be moved to the left toward sewing head assembly 34, with guide plate 52 passing over rod 76 and flexible drum 78 thereon, the rod and drum flattening extending portion 98 against the underside of the guide plate to form a fold on the leading edge of the handle stock. By the time drum 78 is adjacent the rear tip of extending portion 98, guide plate 52, with fold 16 form thereon is located under the sewing head.

Figure 11:
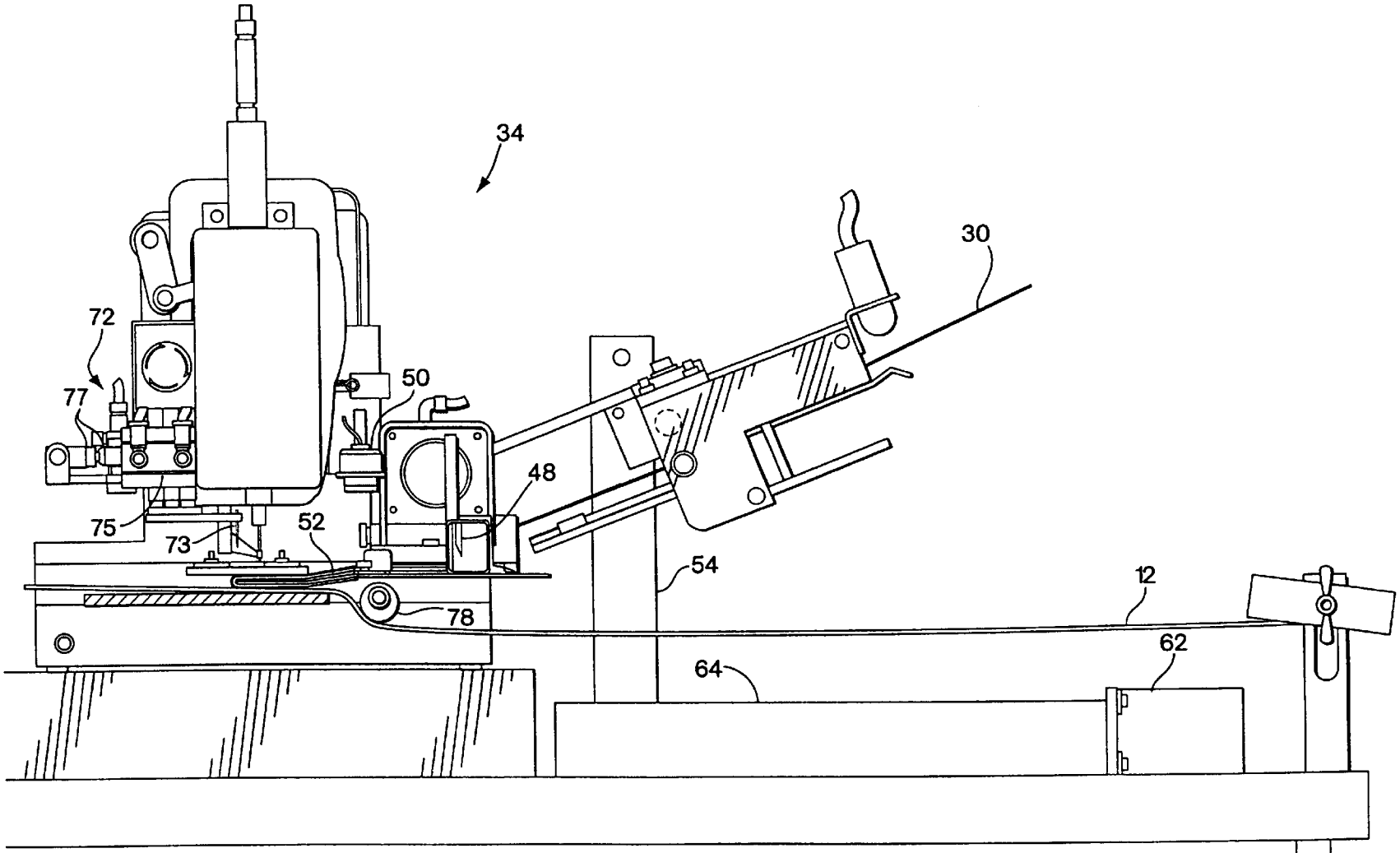
Figure 12:
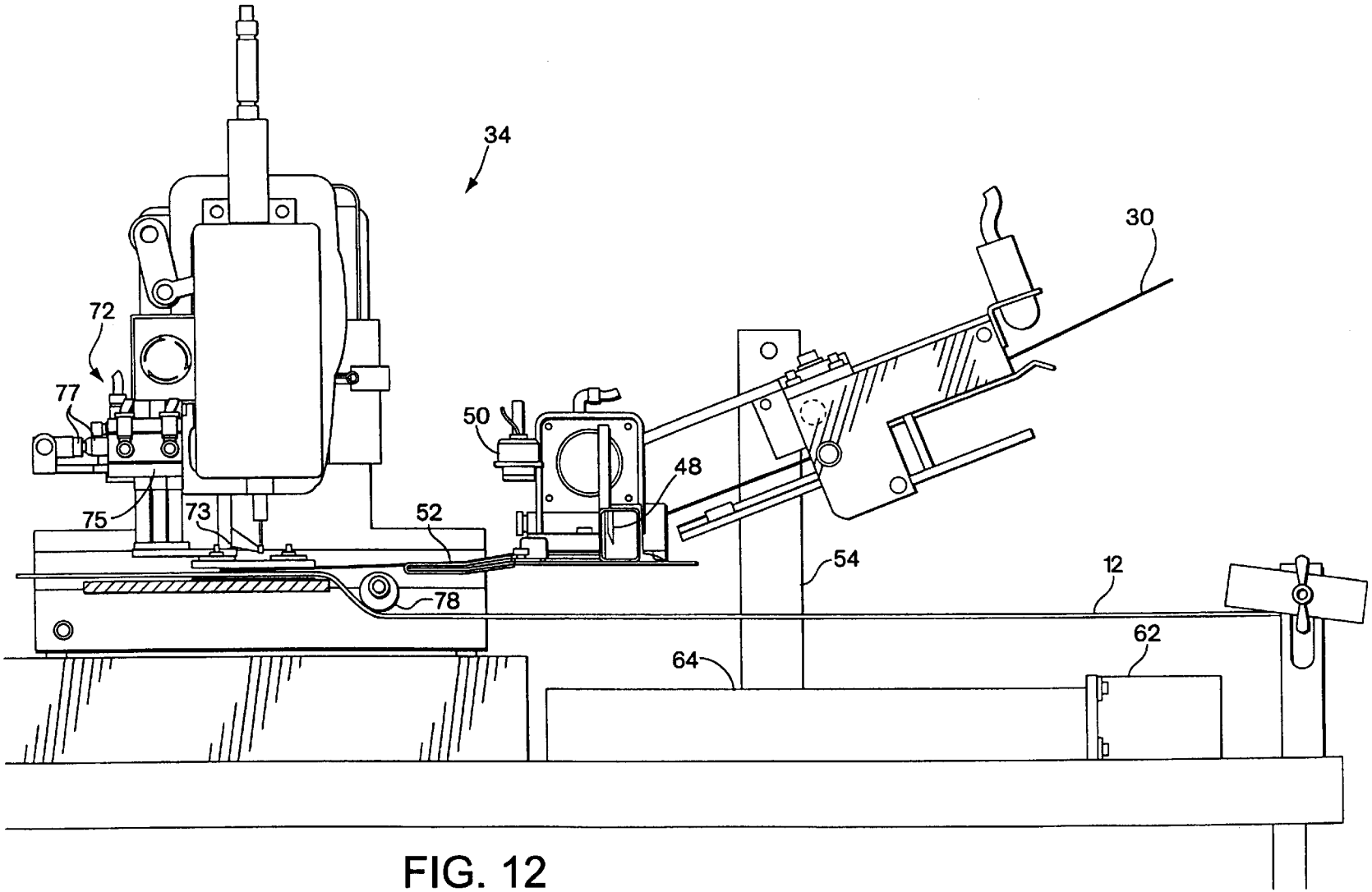
Figure 13:
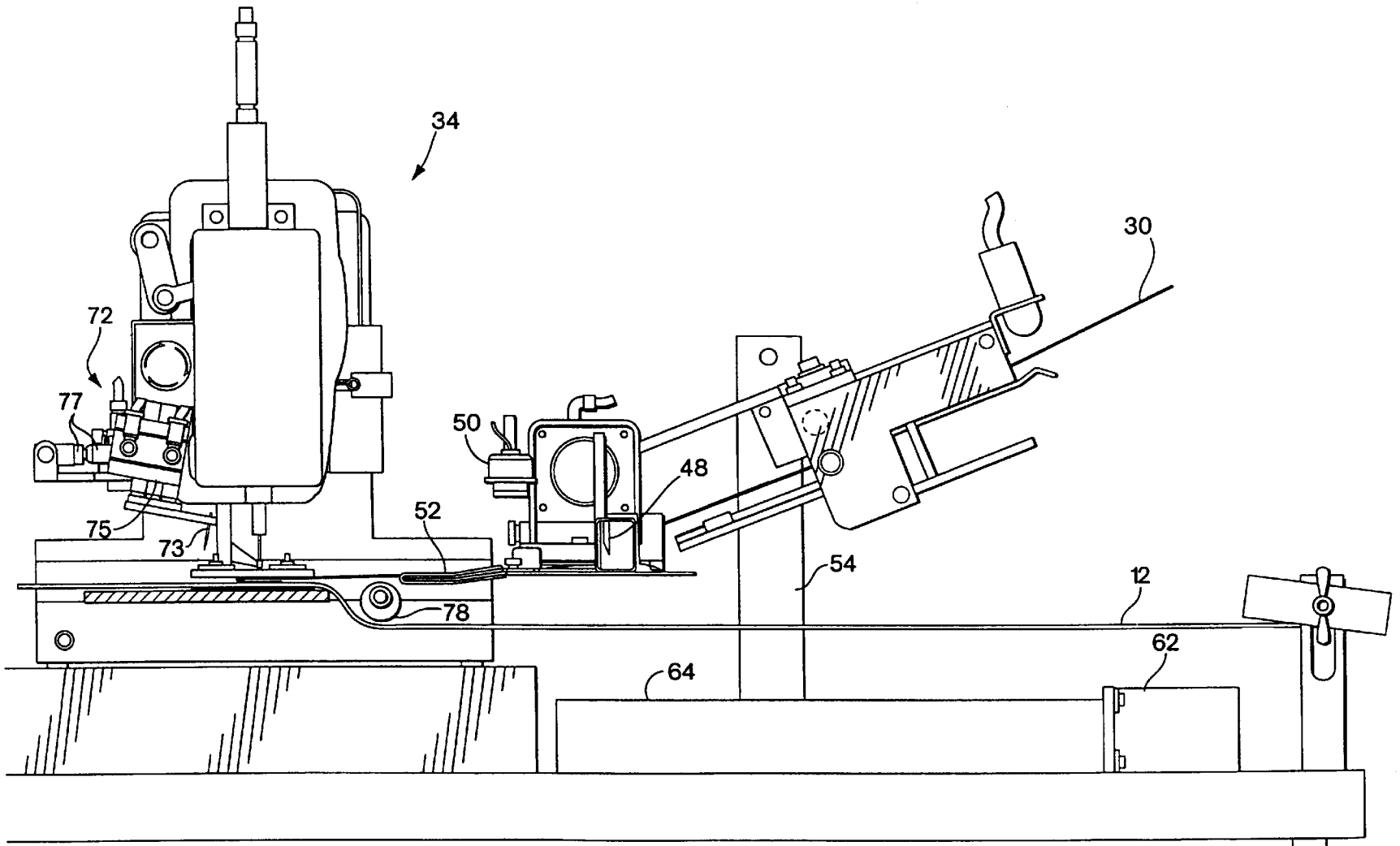

At this point, staking pin assembly 78 is operated to move the staking needle, which have heretofore been in a tilted position out of the way, to a substantially vertical position (FIG. 11) and to pneumatically drive these needles into fold 16, the needles passing through slots 53 in guide plate 52, to hold the fold in place. Once the staking needles are in place, feed assembly 42 may be moved to the right as shown in FIG. 12 to withdraw guide plate 52 from fold 16. Clamp 74 of the sewing machine may then be lowered (FIG. 13) to press fold 16 against binding stock 12 and to press both the fold and binding stock against a backing plate 75. The removal of guide plate 52 from the fold and the activation of the sewing machine clamps can occur substantially concurrently. Once the fold has been clamped, staking needles 73 may be retracted by pneumatic actuators 75 and the needles tilted out of the way by pneumatic actuators 77 (FIG. 13). When these operations have been completed, the fold 16 of handle 10 may be sewn to binding stock 12 by sewing head 70 utilizing the programmed stitch pattern previously selected.

Figure 14:
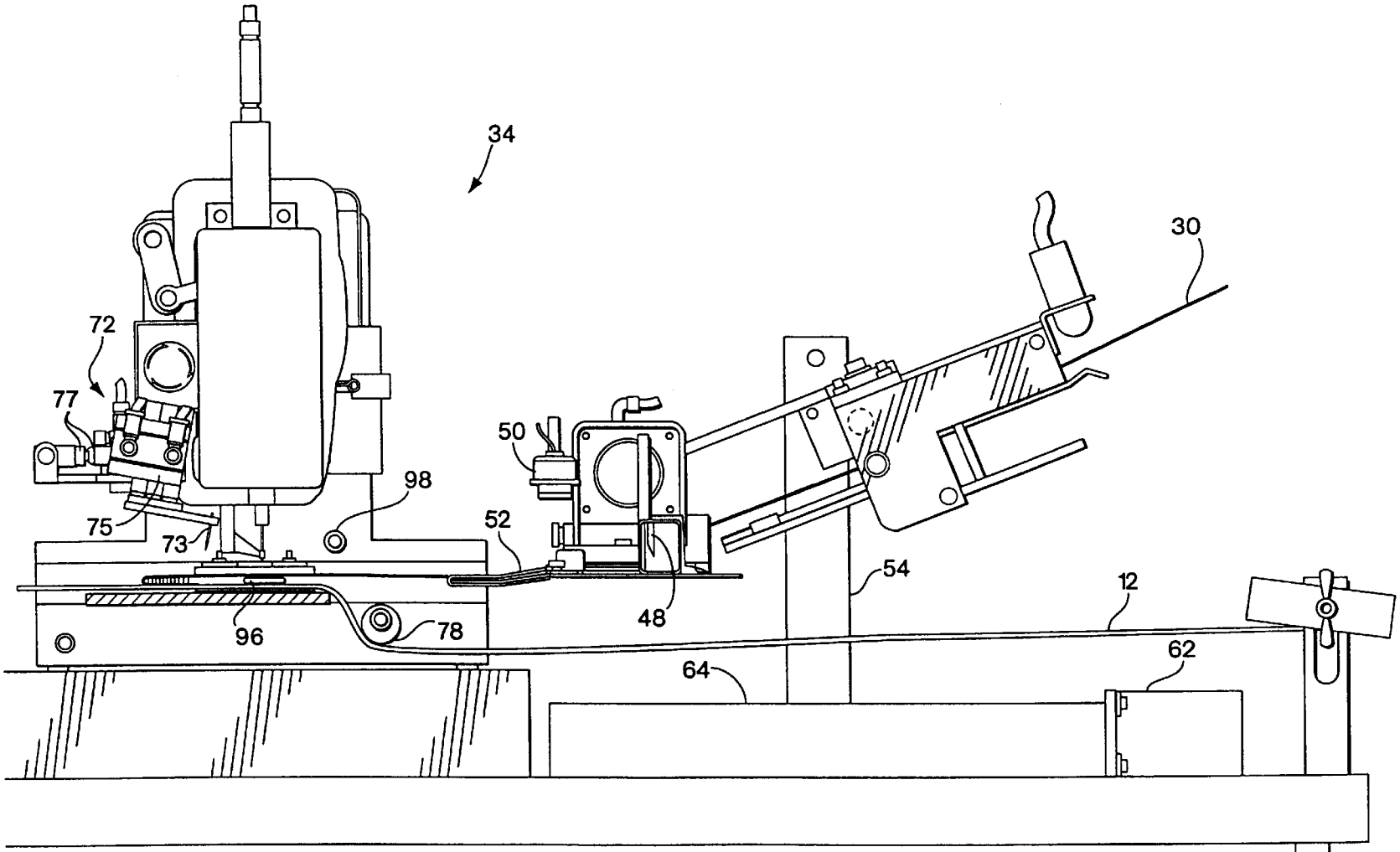
Figure 15:
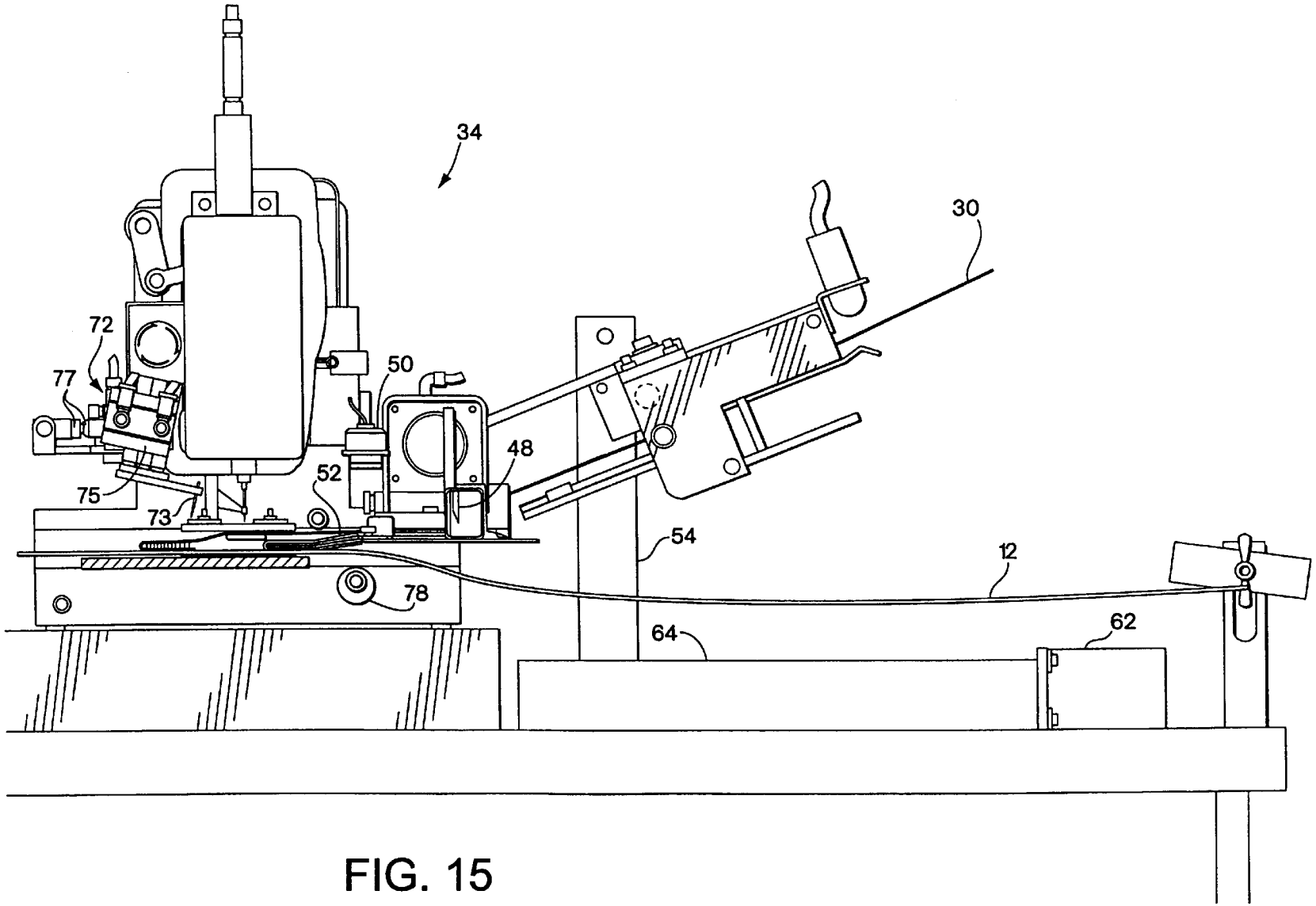

Once the sewing operation has been completed, the sewing clamp is deactivated to release the handle and binding stock. At roughly the same time, cutter blade 48 is operated to cut handle stock 30, the handle stock to the left of the cut being sufficient to form a single handle 10. Once the front fold of handle 10 has been sewn to binding stock 12, advancing the binding stock through the operation of feed rollers 38 also results in an advancing of handle 10. Thus, referring to FIG. 14, once a sewing operation has been completed, cutting blade 48 is pneumatically operated to cut handle stock 30, leaving material for a single handle attached to the binding stock. The binding stock is then advanced about 2 inches at which time pneumatic cylinder 84 is energized to move folding blade 96 and folding bar 98 adjacent sewing head 20. At this time, pneumatic cylinder 92 is operated to retract or lower blade 96 and pneumatic cylinder 94 is operated to raise folding bar 98 so that, as shown in FIG. 15, when these components are moved adjacent the sewing head, folding blade 96 is under the stock for handle 10 and folding bar 98 is above the handle stock.

Figure 16:
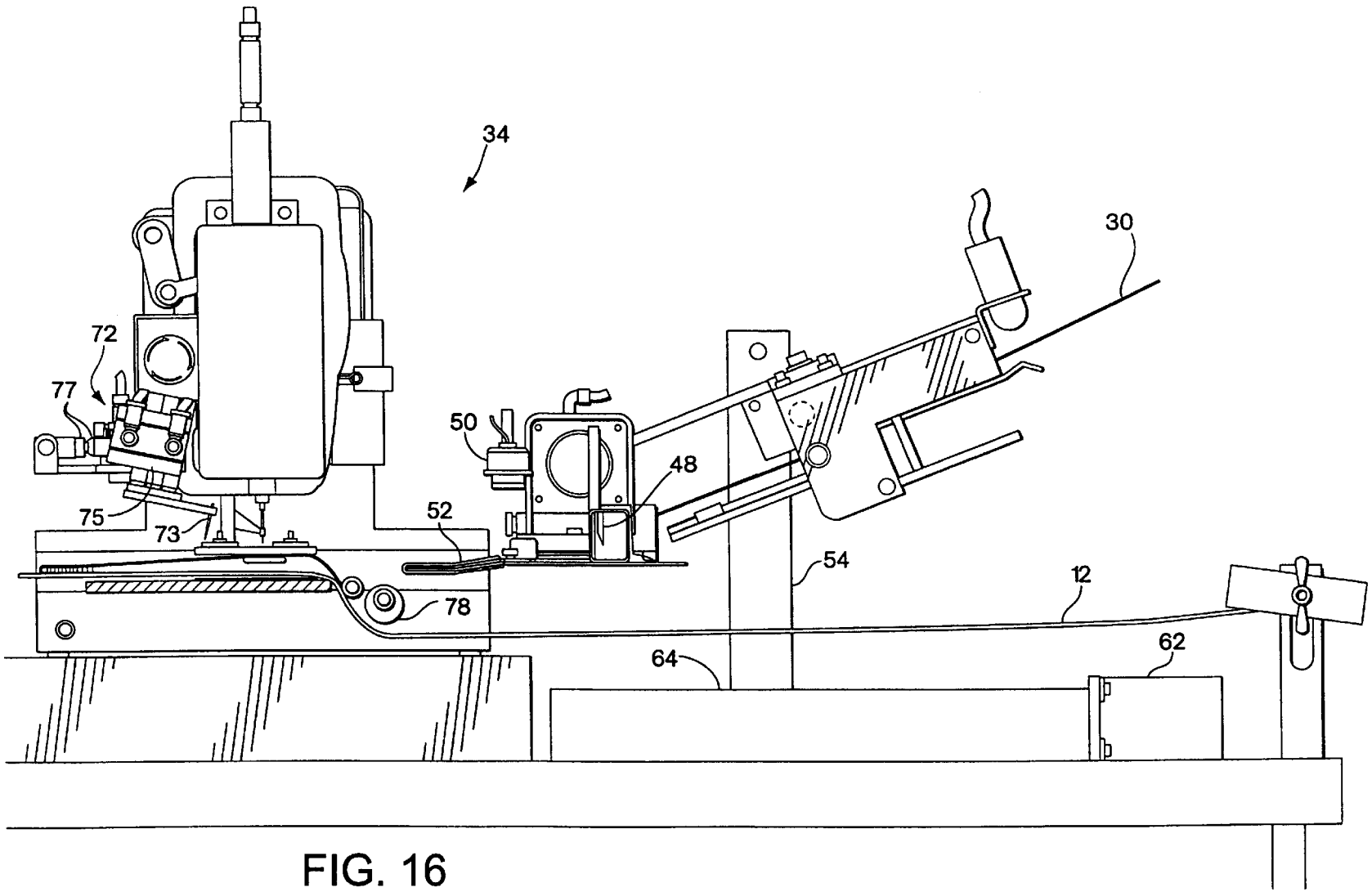
Figure 17:
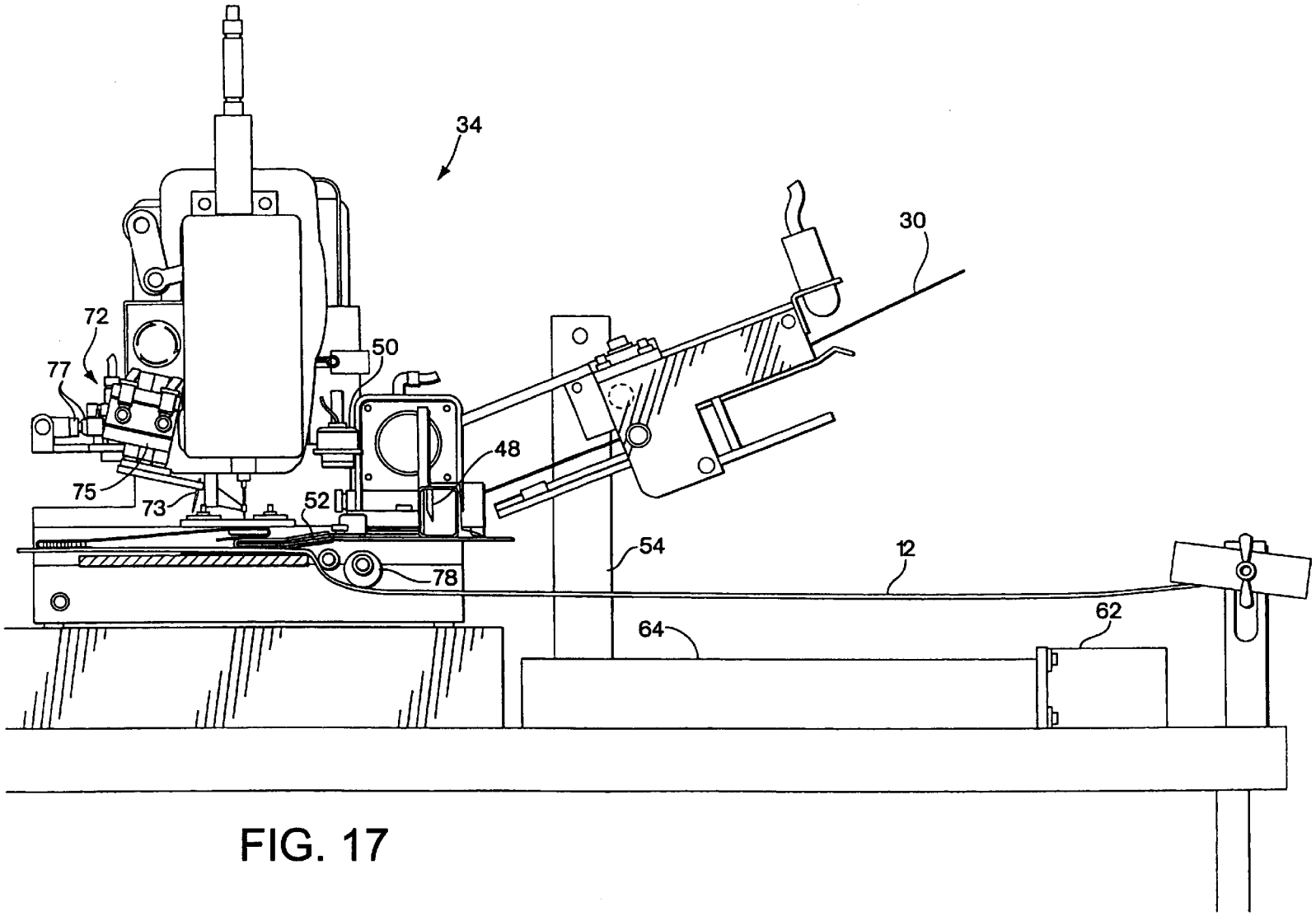

During the next step in the operation, as shown in FIG. 16, folding blade 96 is moved up by cylinder 92 and, substantially concurrent therewith, feed assembly 42 is moved to the left by motor 62 in the manner previously discussed until detector 50 is spaced from the trailing edge of blade 96 by a distance roughly equal to the desired length of the rear fold, which length is substantially equal to the length 98 of the forward fold, this position being shown in FIG. 17. Rollers 38 continue to move binding stock 12 and handle 10 sewn thereto to the left as these operations are occurring. When the trailing edge of handle 10 is detected by detector 50, the drive for feed rollers 38 is stopped and motor 62 is operated to back off feed assembly 42 as shown in FIG. 17. Also as shown in View 10, folding bar 98 is lowered by cylinder 94 to bring the rear side of handle 10 against the trailing edge of folding blade 96, roller 98 being closely adjacent to the trailing edge of the blade. Collars 99 on roller 98, which are spaced by roughly the width of handle 10, function to properly align the rear fold of the handle as this fold is being pushed down over the trailing edge of folding blade 96. The collars may be slightly tapered to facilitate this alignment function.

Figure 18:
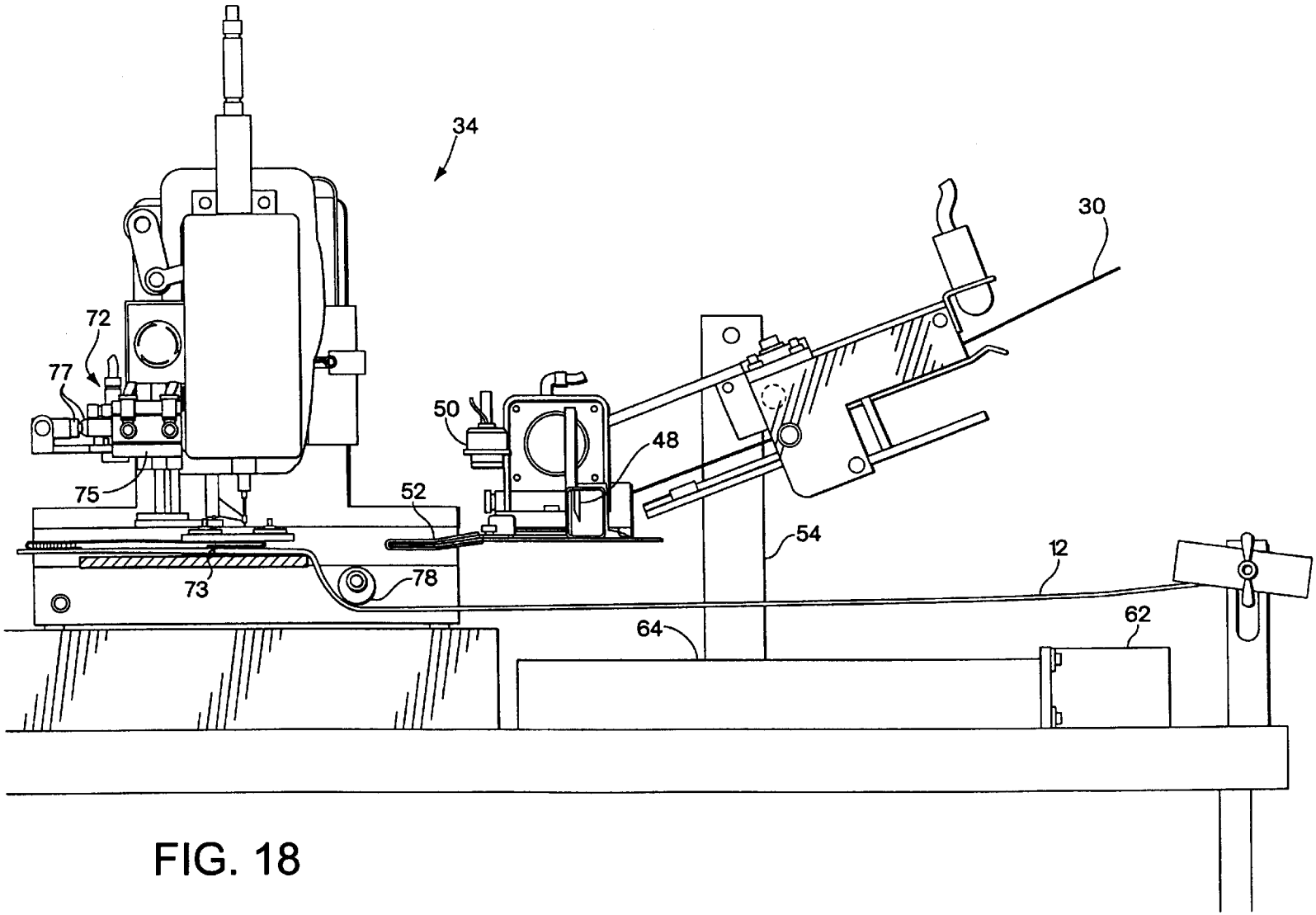

Once this operation has been completed, assembly 42 is again moved to the left toward the sewing head by motor 62, guide plate 52 at this point passing under blade 96 to tuck the rear fold of the handle under folding blade 96 as shown in FIG. 18 to complete the reverse rear fold. Fingers 55 also perform an alignment functions during this operation. The fold is slightly longer than folding bar 96 so that, when these operations are completed, pneumatic actuators 77 and 75 may again be operated in that order to drive staking needle 73 into the leading edge of the fold (FIG. 19).

Figure 19:
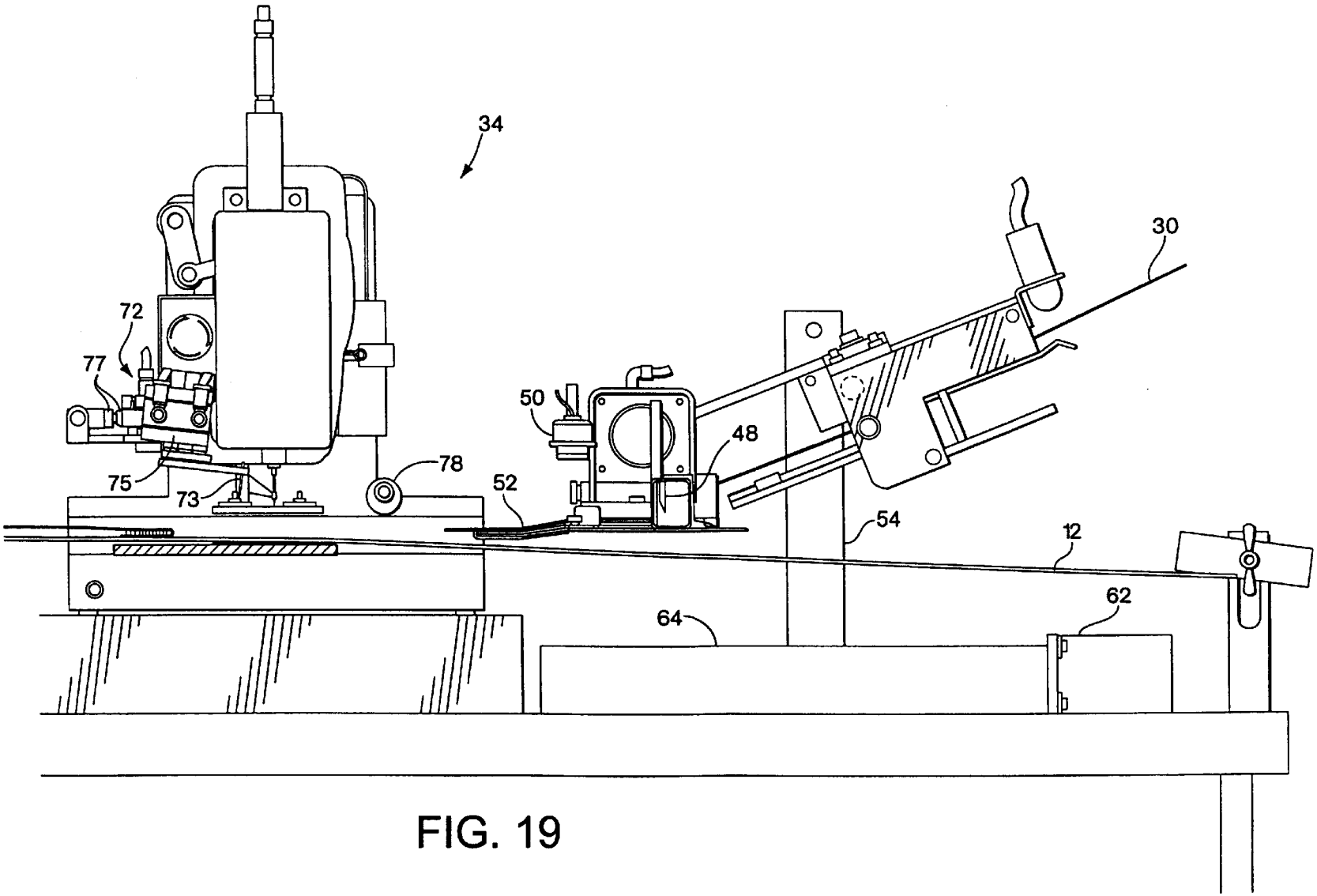

When these operations have been completed, the folding blade is moved down by cylinder 92 and motor 62 is again operated to retract assembly 42 and in particular to remove guide plate 52 to, for example, the position shown in FIG. 19. Substantially concurrent with these operations, sewing machine clamp 74 is activated and cylinder 84 is activated to extend arm 86, removing blade 96 from the fold and removing assembly 80 out of the way. Once these operations have been completed, staking needles 73 are removed and tilted out of the way in the manner previously described and the sewing head is activated to sew the rear fold of handle 10 to border stock 12.

One major advantage of the procedure described above for sewing the rear fold of the handle is that, by detecting when the trailing edge of handle 10 is in position for the rear fold rather than relying on border stock 12 being moved by drive rollers 38 the required distance to bring the rear side of the handle to the desired position, any errors in positioning the handle stock for forming the rear fold as a result of stretching of the border stock is eliminated, resulting in greater uniformity in handle lengths and significantly reducing the likelihood of slack in the handle after sewing so that the handle will lie flat against the border stock.

Once the operations described above have been completed, rollers 38 are operated to advance border stock 12 to bring the location where the next handle is to be sewn adjacent sewing head 70, rollers 46 are operated to bring a length of handle stock 98 beyond the end of guide plate 52 and the machine is otherwise set up as shown in FIG. 8 and FIG. 19 to sew the next handle on border stock 12. When all four handles 10 for a given piece of border stock have been sewn, rollers 38 advance the border stock with the handles sewn thereon until the end of the border stock is adjacent cutter 40, cutter 40 being then operated to complete the fabrication of a single border. This advancing may be interrupted to sew the first handle on the next border if appropriate. When detector 44 detects that the end of a roll of handle stock 30 has been reached, computer 106 will determine if there is sufficient handle left to complete the handle currently being sewn. If not, the operation will be terminated at that point until a new roll of handle stock is mounted on spindle 26 and an operator restarts the operation. If there is sufficient handle stock to complete the handle being sewn, this operation is completed before the operation of the machine is stopped.

While the discussion of above is with reference to a preferred embodiment, it is apparent that many variations on the details of operation for this embodiment are possible. For example, in FIG. 18, rather than using guide plate 52 to tuck the end of the rear fold under blade 96, roller 98 could be moved under the blade by a suitable mechanism to effect this tuck, blade 96 could initially be positioned past the sewing head and moved back over roller 98 to effect this operation, or relative movement between these components could be achieved in some other way. Similarly, the location of detectors 44 and 50 could be varied, although, for reasons discussed above, the current locations are considered preferable. Hydraulic, electromagnetic or other suitable actuators, or electric motors could be substituted for various of the pneumatic actuators, the component moved to effect relative movement between two components may be varied, and other suitable variations could be made in the specific components used and in the sequences of operation to achieve the desired results. Thus, while the invention has been particularly shown and described above with reference to a preferred embodiment, it should be understood that this embodiment is for purposes of illustration only and that the foregoing other changes in form and detail may be made therein by one skilled in the art while still remaining within the spirit and scope of the invention, which is to be defined only by the appended claims.

What is claimed is:

1. Apparatus for sewing handles lengthwise on an elongated strip of material including:

a first handle stock feeding assembly;

a second sewing head assembly;

a first programmably controlled drive for effecting relative movement between the first assembly and the second assembly toward and away from each other;

a second programmably controlled drive for feeding said strip of material to and through a sewing head of said sewing head assembly;

said first assembly including an extending guide plate coacting with first components of said second assembly as said drive moves the first assembly and second assembly toward each other to form a fold on a leading edge of the handle stock and deliver the fold to the sewing head where it is sewn to the strip of material;

a cutter on said first assembly for cutting a sufficient length of said handle stock to form said handle; and said extending guide plate coacting with second components of said second assembly to form a fold at said sewing head on a trailing end of said handle, said fold being sewn to the strip of material to complete the handle.

2. Apparatus as claimed in claim 1 wherein a length of handle stock sufficient to form said fold extends beyond the end of said guide plate when said guide plate reaches said first components, said first components including a folding bar and a drive moving said bar down over the leading edge of said guide plate to fold said length of handle stock down, said guide plate passing over said bar as said assemblies continue to move toward each other, the bar pressing said length of handle stock against the bottom of the guide plate to form the fold.

3. Apparatus as claimed in claim 2 wherein said bar includes a flexible drum thereon coacting with edge projections on said guide plate to assure proper alignment for the folded-over length of handle stock.

4. Apparatus as claimed in claim 3 wherein said flexible drum maintains a desired tension on the handle stock.

5. Apparatus as claimed in claim 1 wherein said second assembly includes staking needles, and a drive mechanism which moves the needles into engagement with each fold when the fold is at the sewing head, retracts the staking needles when the fold is clamped by the sewing head and tilts the staking needles out of the way when retracted.

6. Apparatus as claimed in claim 1 including a trailing end detector for said handle, said guide plate coacting with said second components to form said fold on the trailing end of said handle in response to an output from said detector.

7. Apparatus as claimed in claim 1 wherein said second components include a rear folding bar and a folding blade, said bar and blade normally being retracted to an inoperative position; a drive for moving said bar and blade to an operative position at a selected time after the fold at the leading end of the handle has been sewn to the strip of material; and a drive which moves said folding bar down past a trailing edge of said blade when only a length of the trailing end of the handle stock sufficient to form said fold on the trailing end of the handle extends beyond the trailing edge of the blade, the bar folding the trailing end of the handle over the trailing edge of the blade; and including means for folding said trailing end of the handle under said blade to form said trailing end fold on the handle.

8. Apparatus as claimed in claim 7 wherein said bar includes components for effecting alignment of the trailing end fold.

9. Apparatus as claimed in claim 8 wherein said means for folding the trailing end includes said programmably controlled drive moving said guide plate under said blade, said guide plate also including components facilitating alignment of the fold trailing end.

10. Apparatus as claimed in claim 8 wherein said means for folding the trailing end includes means for moving said folding bar and blade relative to each other so that said bar passes under said blade to fold said trailing end of the handle thereunder.

11. Apparatus as claimed in claim 1 wherein said strip of material is an elongated strip of mattress border materials.

12. Apparatus for automatically sewing handles lengthwise on an elongated strip of material including:

a first mechanism which forms a fold on a leading end of a handle stock;

a second mechanism, operative after said first mechanism, which moves said handle stock to bring said fold to a sewing head, the sewing head sewing the fold to the strip of material;

a cutter, operative after the sewing of said fold to the strip, for cutting a sufficient length of the handle stock to form said handle; and a third mechanism for forming and delivering to said sewing head a fold on a trailing end of said handle, said sewing head sewing the fold on the trailing end to the strip of material to complete the handle;

at least one of said first, second and third mechanisms sharing at least one component from at least one other of said mechanisms.

13. Apparatus as claimed in claim 12 including programmable controls for the operation of said apparatus.

14. Apparatus as claimed in claim 12 wherein said first and third mechanisms each include components which facilitate alignment of the fold formed by such mechanism.

15. A method for automatically sewing handles lengthwise on an elongated strip of material including:

(a) forming a fold on a leading end of a handle stock;

(b) moving said handle stock to bring the fold formed during step (a) to a sewing head where the fold is sewn to the strip of material;

(c) cutting a sufficient length of the handle stock behind the fold sewn during step (b) to form a said handle;

(d) forming a fold on a trailing end of said handle;

(e) delivering the fold formed during step (d) to said sewing head; and (f) sewing the fold on the trailing end to the strip of material to complete the handle.

16. A method for sewing handles lengthwise on an elongated strip of material including:

a) feeding said strip of material to and through a sewing head, said feeding being programmably controlled;

b) feeding a leading end of handle stock to extend beyond the end of a guide plate on a feed assembly by a length sufficient to form a handle fold;

c) moving a folding bar down past the tip of said guide plate to fold the extending handle stock down over said guide plate;

d) moving said feed assembly toward the sewing head with said guide plate over said fold bar to form a handle fold, step (d) continuing until the fold is at the sewing head;

e) using the sewing head to sew the fold on the handle stock to the strip of material;

f) cutting said handle stock at a point so as to provide sufficient handle stock to form said handle;

g) continuing step (a), the handle now sewn to the strip of material moving therewith;

h) moving a second folding bar and a folding blade into a position adjacent said sewing head with said bar above the handle and adjacent the trailing edge of the blade, and the blade below the handle;

i) detecting when the cut trailing end of the handle reaches a selected position;

j) moving the second folding bar down past the trailing edge of the blade when a length of the handle sufficient to form a fold extends beyond said trailing edge to fold said length of material down;

k) moving said feed assembly toward said sewing head with said guide plate under said blade to form a fold formed in step (c) on the trailing end of the handle; and l) sewing the fold to the strip of material to complete the handle.

17. A method as claimed in claim 16 including the steps performed after step (d) and after step (k) of (m) moving staking needles down into said fold, (n) moving said feed assembly, including said guide plate, away from said sewing head (o) clamping said fold, and (p) moving the staking needles up out of the fold and tilting the staking needles out of the way.

18. A method as claimed in claim 16 wherein step (c) includes utilizing a resilient drum on said folding bar acting in conjunction with edge projections on said guide plate to align the fold formed during this step.

19. A method as claimed in claim 16 wherein said strip of material is an elongated strip of mattress border material.

20. A method as claimed in claim 16 wherein step (j) includes utilizing alignment components on said second folding bar to align the fold formed during this step.

* * * * *